US005458278A

United States Patent [19]

LaConte

[11] Patent Number: 5,458,278

[45] Date of Patent: Oct. 17, 1995

[54] ARTICLE CARRYING BAG AND METHOD FOR USING SAME

[75] Inventor: Michael LaConte, 1538 W. Wolfram, Chicago, Ill. 60657

[73] Assignee: LaConte; Michael, Chicago, Ill.

[21] Appl. No.: 177,931

[22] Filed: Jan. 6, 1994

[51] Int. Cl.[6] ..... A45F 3/04

[52] U.S. Cl. ..... 224/209; 224/153; 383/40

[58] Field of Search ..... 383/38, 40, 41, 383/66, 76, 117, 6, 103; 224/209, 227, 242, 245, 249, 254, 259, 153; 150/109, 106, 131, 133, 134, 100, 101, 102, 113; 190/115, 102, 103; 24/387; 206/315.3, 315.5, 232; D3/219

[56] References Cited

U.S. PATENT DOCUMENTS

| | | | |
|---|---|---|---|
| D. 351,061 | 10/1994 | Coons | D3/219 |
| 2,697,465 | 12/1954 | Johnson | 383/40 |
| 2,897,863 | 8/1959 | Somers, Jr. | 383/103 |
| 4,117,874 | 10/1978 | Berenguer | 383/40 |
| 4,156,446 | 5/1979 | Nathan | 383/40 |
| 4,236,615 | 12/1980 | Ginat | 190/103 |
| 4,263,951 | 4/1981 | Siegel | 150/113 |
| 4,463,789 | 8/1984 | Leiserson | 224/245 |
| 4,466,124 | 8/1984 | Kirkham, Jr. | 224/153 |
| 4,506,769 | 3/1985 | Franco et al. | 190/115 |
| 4,657,135 | 4/1987 | Kjose | 206/315.3 |
| 4,911,292 | 3/1990 | Airey, Jr. | 206/315.3 |
| 5,031,944 | 7/1991 | Keyaki | 24/387 |
| 5,050,998 | 9/1991 | Wachtel | 224/209 |
| 5,050,999 | 9/1991 | Van Loon, III | 383/76 |
| 5,176,102 | 1/1993 | Tracy | 224/209 |

FOREIGN PATENT DOCUMENTS

| | | | |
|---|---|---|---|
| 1021467 | 2/1953 | France | 383/76 |
| 1356348 | 2/1964 | France | 224/209 |
| 58258 | 8/1937 | Netherlands | 150/106 |
| 63576 | 6/1941 | Norway | 224/209 |
| 291934 | 6/1928 | United Kingdom | 206/315.3 |

*Primary Examiner*—Henry J. Recla
*Assistant Examiner*—Gregory M. Vidovich
*Attorney, Agent, or Firm*—Hill, Steadman & Simpson

[57] ABSTRACT

A bag is provided for carrying articles, particularly articles to be laundered. A compartment is provided having an interior and an opening to provide access to the interior. A fastener, such as a zipper, extends along the length of the compartment. The fastener, when opened, expands the opening to provide greater access to the interior. A drawstring is secured about a periphery of the compartment at the opening to adjust the size of the opening. At least one strap is integrally formed with the compartment to assist in maneuvering the compartment. Additional compartments or pockets are provided separate from the other compartment for carrying other articles, such as articles associated with the laundering process. The bag is particularly suited for carrying over at least one or both shoulders of an individual.

16 Claims, 2 Drawing Sheets

ARTICLE CARRYING BAG AND METHOD FOR USING SAME

BACKGROUND OF THE INVENTION

The present invention generally relates to a bag for carrying articles. More specifically, the present invention relates to a bag for carrying laundry and miscellaneous articles associated with laundering the articles contained in the bag. The bag is particularly suited for carrying by an individual over his or her shoulders.

Of course, tote-type bags are generally known for carrying articles. Such tote bags are particularly useful for traveling and the like. Another known tote-type bag is a laundry bag useful for the individual in carrying his laundry to, for example, a laundromat.

Typical laundry bags are made of a fabric and are shaped to form an enclosed volume when gathered. Often, such laundry bags are provided with a drawstring for enclosing an opening at the end of the bag through which clothes, laundry or other articles are inserted for carrying thereof. Such laundry bags are often difficult to load and to unload.

Furthermore, these known types of laundry bags can be difficult and cumbersome to tote both to and from the laundering location.

Known laundering bags further suffer from the drawback that a single compartment is only provided in which everything required for laundering must be carried. Therefore, laundry detergent, bleach, fabric softener, change or money for operating the machines, and the like, must either be placed in the laundry bag with the articles therein or separately carried.

A need, therefore, exists for an improved tote, particularly for carrying articles to be laundered and miscellaneous articles associated with the laundering process.

SUMMARY OF THE INVENTION

The present invention provides a tote for carrying articles within an enclosure secured by a drawstring. A pair of straps are provided for carrying the tote either by using the straps as handles or placing the straps over the shoulders. Furthermore, the tote includes side pockets particularly suited for carrying detergents, bleaches, fabric softeners and the like to assist in laundering the articles carried within the tote. Still further, a drawstring is provided for securing the opening to the tote. The drawstring includes a change purse at an end thereof for holding, for example, money required for the laundry, keys, and the like.

To this end, the present invention provides a bag for carrying articles therein. The bag comprises a compartment having an interior and an opening at one end of the compartment to provide access to the interior. A fastener extends along the length of the compartment wherein the fastener, when opened, expands the opening providing greater access to the interior. A drawstring is secured about a periphery of the compartment at the opening to adjust the size of the opening. A strap is integrally formed with the compartment to assist in maneuvering the compartment.

In an embodiment, the bag of the present invention further provides at least one pocket integrally formed with an exterior surface of the compartment for separately carrying articles from the interior. A fastener is further provided for selective access to the at least one pocket.

In an embodiment, the bag of the present invention has a separate container connected to the drawstring.

In an embodiment, the strap is secured to the compartment substantially about its periphery forming handles for carrying the compartment.

In an embodiment, the strap is secured to the compartment to form loops for carrying the compartment over at least one shoulder of an individual.

The present invention further provides a laundry bag for carrying a set of articles and at least one other article separately from the set of articles. The laundry bag comprises a main compartment having an interior for carrying the set of articles to be laundered. An opening provides access to the interior of the main compartment. A length of cording reduces the opening thereby limiting access to the interior of the main compartment. A secondary compartment has an interior distinct from the main compartment for holding the at least one other article, the secondary compartment integrally formed with the main compartment. A fastener extends along the length of the main compartment to expand the opening of the main compartment providing increased access thereto.

In an embodiment, a fastener encloses the secondary compartment.

In an embodiment, a purse is connected to the drawstring for holding miscellaneous articles.

In an embodiment, the secondary compartment includes a plurality of pockets. The plurality of pockets may be selectively opened and closed with at least one fastener.

In an embodiment, at least one handle is secured to an exterior surface of the main compartment. The at least one handle is constructed and arranged to carry the main compartment over at least one shoulder of an individual.

The present invention further provides a method for adding or removing articles from a carrier. The method comprises the steps of: providing a compartment having an interior capable of housing the articles; providing an opening for limited access to the compartment for loading or accessing the articles; providing a fastener for adjusting the size of the opening thereby expanding access to the compartment for complete access to the interior of the compartment when the fastener is opened; providing at least one exterior compartment for separately housing other articles; and providing a second fastener for adjusting the size of the opening without completely closing the opening.

In an embodiment, the method further comprises the step of providing a small container movably arranged on the second fastener.

In an embodiment, the method further comprises the step of providing at least one handle on an exterior of the compartment.

In an embodiment, the method further comprises the step of providing a third fastener for providing access to the at least one exterior compartment.

In an embodiment, the articles in the compartment are laundry and the articles in the at least one exterior compartment are detergents.

It is, therefore, an advantage of the present invention to provide a tote which is easy to carry and to maneuver.

A further advantage of the present invention is to provide a tote for carrying articles, particularly suited for laundry, such as clothing, towels or the like and laundry-type articles.

Still further, an advantage of the present invention is to provide a tote which is easy to load and to unload with articles.

Yet another advantage of the present invention is to provide a tote including miscellaneous compartments for carrying articles separately from the articles contained within the tote.

Still further, an advantage of the present invention is to provide a durable tote which is both wear resistant and water resistant.

Additional features and advantages of the present invention are described in, and will be apparent from, the detailed description of the presently preferred embodiments and from the drawings.

BRIEF DESCRIPTION OF TIME DRAWINGS

DETAILED DESCRIPTION OF THE PRESENTLY PREFERRED EMBODIMENTS

A tote-type article carrying bag is provided for carrying articles within a main interior compartment. The tote bag is particularly useful for carrying articles for laundering, such as clothes, sheets, towels, and the like. Further, the tote bag carries articles for assisting in the laundering process, such as detergent, bleach, fabric softener, money and/or change.

Figure 1:
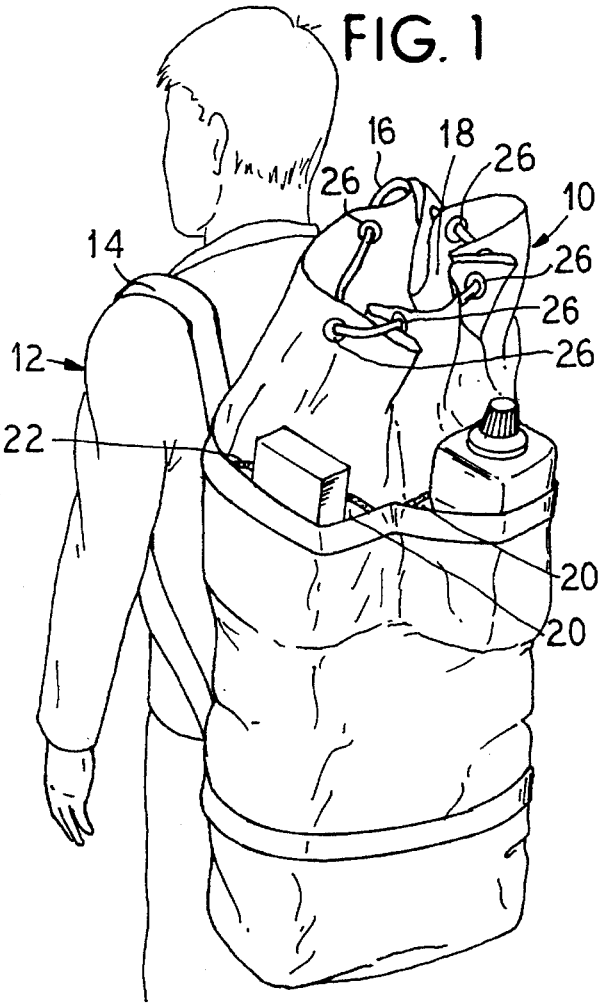
FIG. 1 illustrates a perspective view of an embodiment of a tote of the present invention as carried by a user.

Referring now to the drawings, wherein like numerals designate like parts, a tote bag 10 is generally illustrated as carried by an individual 12. The tote bag 10 as illustrated is carried by the individual 12 with the assistance of a pair of straps 14 (one of which is shown in FIG. 1). The straps 14 may be placed, for example, over the shoulders of the individual 12 or may be used as handles for simple carrying by the individual 12 by gripping the straps 14 with one or more hands of the individual 12.

The tote bag 10 includes a drawstring 16 which, when tightened, substantially closes an opening 18 providing access to a main interior compartment of the tote bag 10. The main interior compartment is a large volume compartment useful for carrying any amount of articles, such as articles to be laundered.

On the exterior of the tote bag 10 is a pair of pockets 20. While two pockets 20 are shown, it should be understood that any number of pockets may be implemented as desired for the particular needs of the individual carrying the tote bag 10. The pockets 20 are particularly useful for carrying, for example, laundry detergent, fabric softener or the like, particularly when the tote bag 10 is implemented for use as a laundry bag. The pockets 20 may be secured by a fastener 22, such as, for example, a zipper. Of course, other known fasteners may be implemented by the skilled artisan for providing secured opening and closing of the fasteners and access to the interior of the pockets 20.

Figure 2:
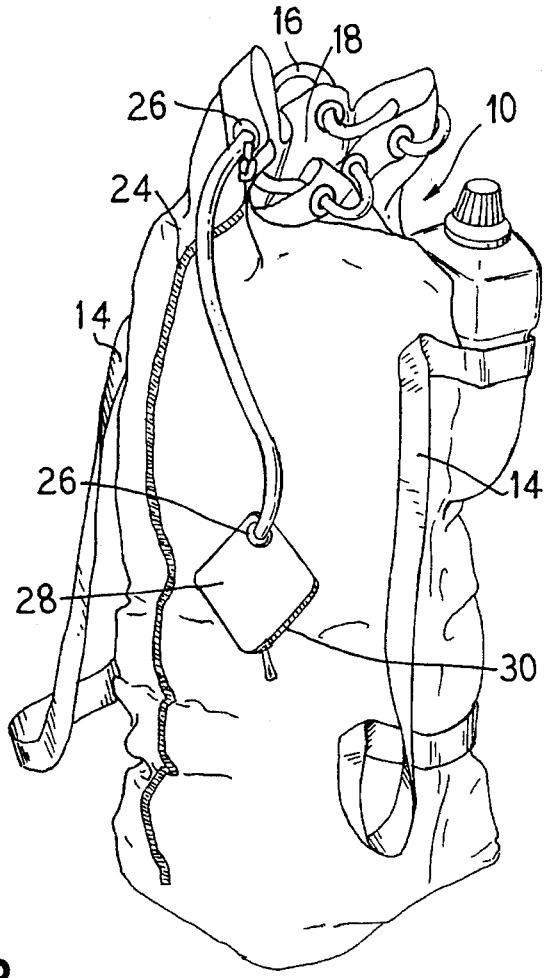
FIG. 2 illustrates a perspective view of the tote of the present invention.

The tote bag 10 may be generally made of a heavy canvas-type material for durability. Of course, other materials such as a reinforced fiber weave, other nylon fabrics or the like may be implemented. The fabric, of course, may be coated with a water or weather repellant as desired. The pockets 20 are constructed and arranged on the exterior of the tote bag 10 opposite the straps 14. The straps 14 may be unitarily formed of a single length of strapping and stitched or otherwise fastened to the exterior of the tote bag 10. The straps 14, when secured as shown in FIG. 2, provide a simple and convenient manner for an individual to grasp the straps 14 and place the same over the shoulders of the individual or, alternatively, for simple carrying by gripping the straps 14 so as to form a handle.

A second fastener 24 is situated along the length of the tote bag 10 from the opening 18 to a point substantially near a base 34 of the tote bag 10. In a preferred embodiment, the fastener 24 is a zipper which opens to provide access to an interior of the tote bag 10. In another embodiment, the fastener 24 is a two-way zipper which provides access to the interior of the tote bag 10 from either the top of the tote bag 10 by expanding the opening 18 or from the base 34 of the tote bag 10 by opening the fastener from the base 34 when closed. Of course, other known fastening means may be implemented by those skilled in the art.

The drawstring 16 which substantially closes and provides limited access to the interior of the tote bag 10 through the opening 18 is generally a length of cording or other rope-like material. The drawstring 16 is threaded about the periphery of the opening 18 through the material of the tote bag 10 through, for example, eyelets 26 which, preferably, provide reinforcement.

At an end of the drawstring 16 is a change purse generally illustrated at 28. The change purse 28 includes an eyelet 26, preferably reinforced, at one corner for the drawstring 16 to pass therethrough. The change purse 28 has an interior which may be accessed through yet another fastener 30 which, like the other fasteners, may be a zipper or other known type of fastener, such as snaps, velcro, or the like. The change purse 28 may be made of an identical material as the tote bag 10 or other materials may be used as desired.

Figure 3:
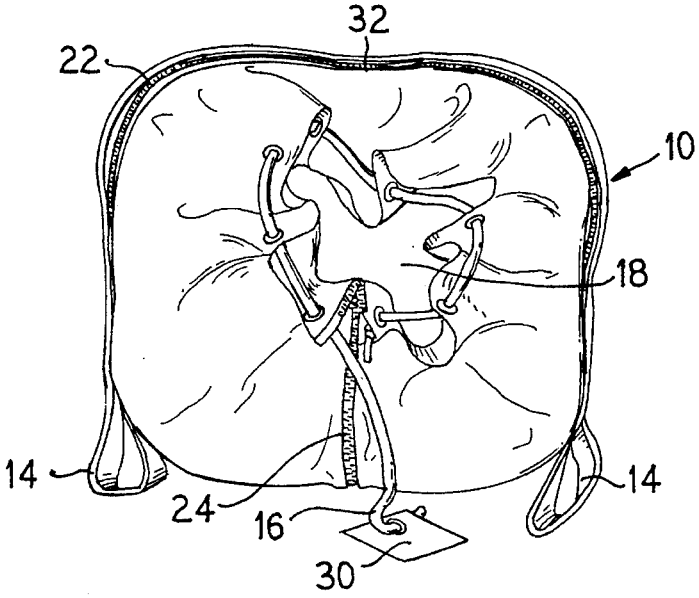
FIG. 3 illustrates a top view of the tote of the present invention.

Referring now to FIG. 3, a top view of the tote bag 10 is illustrated with the drawstring 16 slightly pulled for reducing the size of the opening 18 providing limited access to the interior of the main compartments of the tote bag 10. A single fastener 22, such as the zipper shown, is provided to access the pocket 20. The fabric forming the tote bag 10 is stitched intermediate the length of the fastener 22 just below the point at which the fastener 22 is secured. This stitch point is generally illustrated at 32. The stitching at the point 32 divides the pocket 20 into two sections. Of course, any number of sections or pocket may be provided as desired. Furthermore, a single pocket without a division and without further stitching at the point 32 may be implemented as desired.

Figure 4:
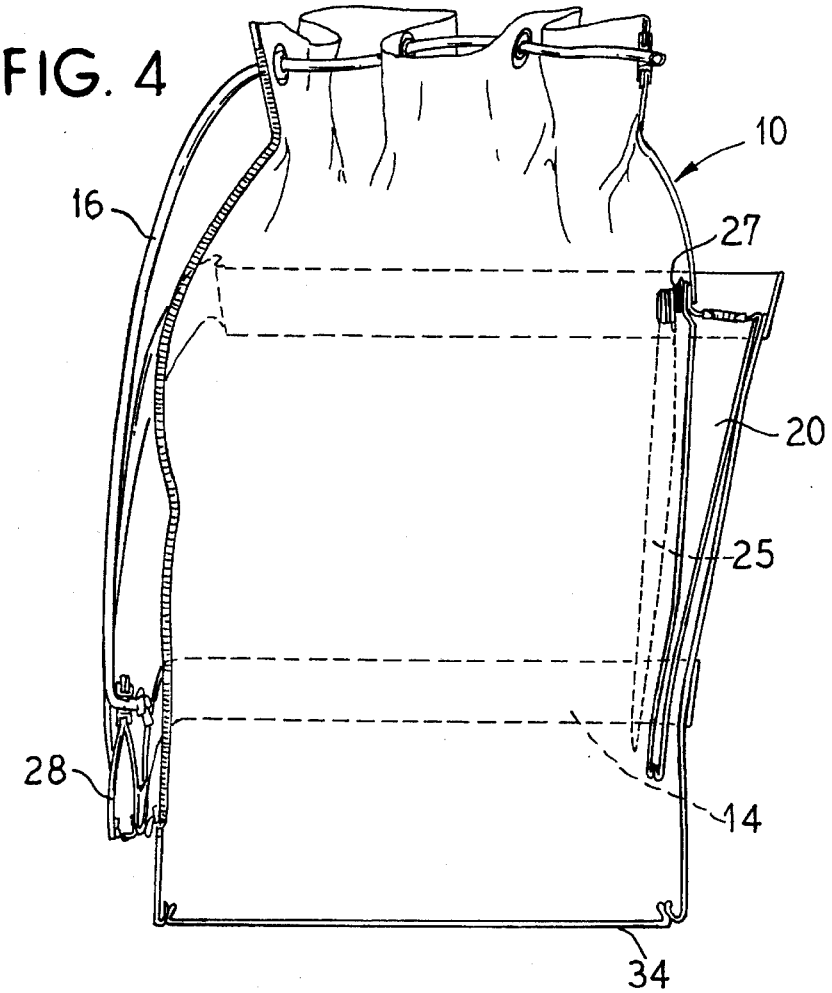
FIG. 4 illustrates a cross-sectional view of the tote of the present invention.

As more clearly illustrated in FIG. 4, the pocket 20 is formed by an additional portion of like material as the tote bag 10. Of course, other materials may be implemented for the pocket 20 The pocket 20 may be formed to extend any length within the interior of the tote bag 10. As illustrated, the pocket 20 extends beneath the attachment of the strap 14 near the base 34 of the tote bag 10.

Figure 5:
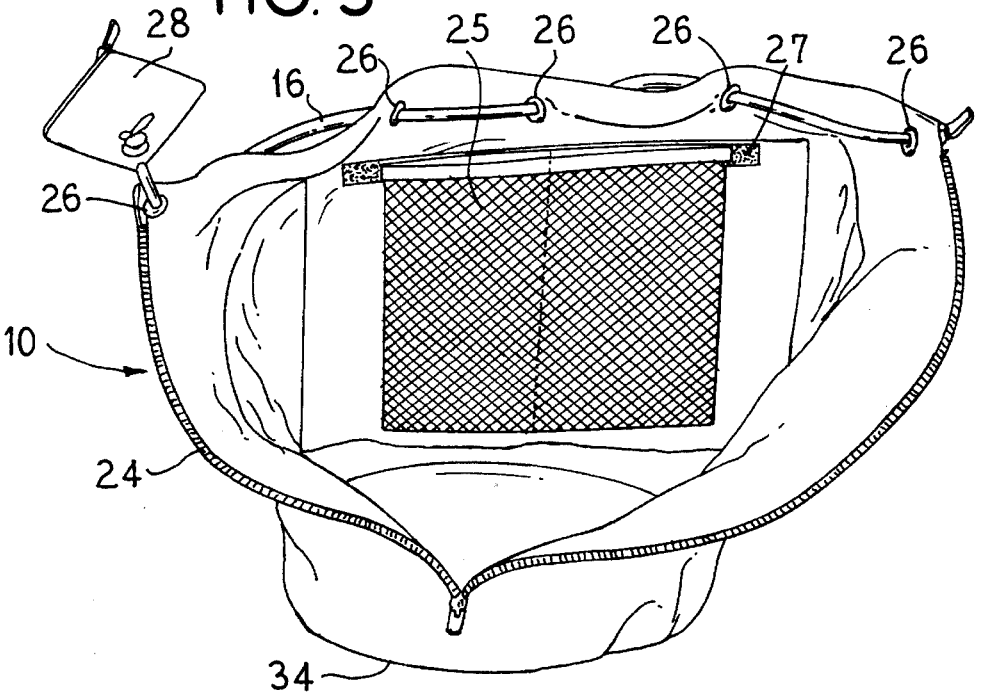
FIG. 5 illustrates a perspective view of the tote of the present invention in a position for access to an interior of the tote.

As further illustrated in FIGS. 4 and 5, an interior bag 25 is provided as a supplement to the tote bag 10. The interior bag 10; is preferably removably secured by, for example, Velcro fasteners 27. Of course, other fastening means, such as snaps, zippers or the like, may be implemented by one skilled in the art for removably securing the interior bag 25 within the tote bag 10.

The interior bag 25, in a preferred embodiment, is made of a meshed fabric material. The material is suitable for laundering with articles (not shown) contained within the bag 25. The bag 25 is particularly suitable for separating fine washables, such as hose, silk garments, and the like, from the other articles within the interior of the tote bag 10.

Of course, other shapes, sizes and materials for the interior bag 25 may be implemented as desired for the particular applications for both the interior bag 25 and the tote bag 10. For example, the interior bag 10 may be made of a more durable material for carrying articles which may potentially damage other articles within the interior of the tote bag 10, such as non-colorfast materials which may "bleed" onto other articles.

The interior bag 25 further includes a closure at one end for selectively opening and closing the end for access to the interior of the bag 25. Again, the closure may be Velcro, snaps, zippers or the like.

FIG. 5 illustrates the tote bag 10 in its open position providing complete access to the interior of the tote bag 10, as well as to the interior bag 25 securing within the interior of the tote bag 10. To this end, the drawstring 16 is completely loosened through the eyelets 26 formed at the periphery of the opening 18 of the tote bag 10. Furthermore, the fastener 24 is positioned in its open position near the base 34 of the tote bag 10. In this manner, an individual may easily and conveniently access any articles within the tote bag 10 for removal thereof or for insertion into the tote bag 10, as well as removal of or access to the interior bag 25.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A bag carrying articles therein comprising:

a compartment having an interior and an opening at one end of the compartment to provide access to the interior;

a fastener extending along the length of the compartment wherein the fastener, when opened, expands the opening providing greater access to the interior;

a drawstring secured about a periphery of the compartment at the opening to adjust the size of the opening;

a strap surrounding and secured about a peripheral portion of the compartment and integrally formed with the compartment to assist in maneuvering the compartment; and at least one pocket having a hidden opening integrally formed with an exterior surface of the compartment for separately carrying articles from the interior, said hidden opening having a peripheral edge defining said hidden opening wherein said strap includes an intermediate portion which is integrally connected to said peripheral edge.

2. The bag of claim 1 further comprising: a second fastener for providing selective access to the at least one pocket.

3. The bag of claim 1 wherein the fastener extending along the length is a zipper.

4. The bag of claim 1 wherein the fastener extending along the length is a two-way zipper.

5. The bag of claim 1 further comprising: a separate container connected to the drawstring.

6. The bag of claim 1 further comprising:

an interior pouch removably secured within the interior of the compartment.

7. A laundry bag for carrying a set of articles and at least one other article separately from the set of articles to be laundered, the laundry bag comprising:

a main compartment having a length and an interior defined by walls to carry the set of articles to be laundered wherein the main compartment is constructed from a substantially imperforate material forming the walls of the main compartment;

an opening having a periphery providing access to the interior of the main compartment;

a length of cording constructed and arranged about said periphery to reduce the opening thereby limiting access to the interior of the main compartment;

a secondary compartment having an interior distinct from the main compartment capable of holding the at least one other article, the secondary compartment integrally formed with the main compartment wherein the secondary compartment is suspended inside the main compartment with access to the interior of the secondary compartment from outside the main compartment;

a fastener extending substantially along the entire length of the main compartment to expand the opening of the main compartment providing increased access thereto and to allow access to the interior of said main compartment along the length of said fastener; and an interior bag removably attached to one of the walls in the interior of the main compartment.

8. The laundry bag of claim 7 further comprising: a second fastener for enclosing the secondary compartment.

9. The laundry bag of claim 7 further comprising:

a purse connected to the cording for holding miscellaneous articles.

10. The laundry bag of claim 7 wherein the secondary compartment includes a plurality of pockets.

11. The laundry bag of claim 10 wherein the plurality of pockets are selectively opened and closed with at least one third fastener.

12. The laundry bag of claim 7 further comprising:

at least one handle secured to an exterior surface of the main compartment.

13. A method for manufacturing a carrier to provide for adding or removing articles from the carrier, the method comprising the steps of:

providing a main compartment having an interior defined by walls capable of housing the articles wherein the main compartment is constructed from a substantially imperforate material forming the walls of the main compartment;

providing an opening having a periphery for limited access to the main compartment, the opening allowing loading or accessing of the articles into the main compartment;

providing a fastener extending substantially along an entire length of the main compartment capable of adjusting the size of the opening thereby expanding access to the main compartment for complete access to the interior of the main compartment when the fastener is opened and to allow access to the interior of said main compartment along the length of said fastener;

providing at least one exterior compartment for separately housing other articles wherein the at least one exterior compartment is suspended into the main compartment and is accessible from outside of the main compartment;

providing a second fastener in connection with said periphery capable of adjusting the size of the opening without completely closing the opening; and providing at least one interior pouch attached to one of the walls of the main compartment within the interior of the main compartment wherein the at least one interior pouch is selectively detachable.

14. The method of claim 13 further comprising the step of:

providing a small container movably arranged on the second fastener.

15. The method of claim 13 further comprising the step of:

providing at least one handle on an exterior of the compartment.

16. The method of claim 13 further comprising the step of:

providing a third fastener for providing access to the at least one exterior compartment.

* * * * *